US005343794A

United States Patent [19]

Andreotti et al.

[11] Patent Number: 5,343,794

[45] Date of Patent: Sep. 6, 1994

[54] INFRARED DECOY METHOD USING POLYDIMETHYLSILOXANE FUEL

[75] Inventors: John Andreotti; Abraham Hirschman, both of Silver Spring, Md.

[73] Assignee: The United States of America as represented by the Secretary of the Navy, Washington, D.C.

[21] Appl. No.: 313,887

[22] Filed: Oct. 7, 1981

Related U.S. Application Data

[62] Division of Ser. No. 31,284, Apr. 4, 1979.

[51] Int. Cl.[5] ..... F42B 4/26; F41H 9/00; F41H 13/00

[52] U.S. Cl. ..... 89/1.11; 89/36.01; 44/320; 102/331; 102/341; 102/364; 250/493.1

[58] Field of Search ..... 102/364, 336, 341, 363; 149/116, 19.1; 44/76, 70, 320; 89/1.11, 36.01; 250/473.1

[56] References Cited

U.S. PATENT DOCUMENTS

| | | | |
|---|---|---|---|
| 2,765,221 | 10/1956 | Lusebrink et al. | 44/76 |
| 3,471,345 | 10/1969 | Lane et al. | 149/42 |
| 3,733,223 | 5/1973 | Lohkemp | 149/116 |
| 4,060,435 | 11/1977 | Schroeder | 102/90 |
| 4,069,762 | 1/1978 | Maury | 102/341 |
| 4,171,669 | 10/1979 | Allen | 102/90 |
| 5,136,950 | 8/1992 | Halpin et al. | 102/336 |

FOREIGN PATENT DOCUMENTS

2911639A1 12/1982 Fed. Rep. of Germany .

OTHER PUBLICATIONS

Lipowitz, *J. Fire & Flammability*, 7, p. 482 (Oct. 1976).

*Primary Examiner*—Edward A. Miller
*Attorney, Agent, or Firm*—Roger D. Johnson

[57] ABSTRACT

A floating torch burning polydimethylsiloxane to provide a decoy over the intermediate infrared spectrum of a ship.

3 Claims, 8 Drawing Sheets

INFRARED DECOY METHOD USING POLYDIMETHYLSILOXANE FUEL

This is a division of application Ser. No. 031,284 filed Apr. 4, 1979.

BACKGROUND OF THE INVENTION

This invention relates to pyrotechnical devices for simulation of other objects and, more particularily, to torches for providing an indistinguishable decoy in the intermediate infrared spectrum of a graybody.

A ship is a complex source whose surfaces are essentially graybody radiators with a distribution of temperatures influenced by internal and environmental factors. For the most part, these temperatures are within a few degrees of ambient air temperature and rarely exceed fifty degrees celsius with the exception of a few hot-spot sources such as the top of a stack or a steam catapult, where internal sources can heat surfaces to one hundred degrees celsius or higher. Depending upon the environment and aspect from which a ship is viewed, its radiant spectrum will be influenced by certain sources more than be others. In general its radiant spectrum will be characteristic of a source near ambient temperature; but there are times, particularly at night when the absence of solar heating allows the contrast between the "skin" of a ship and the sea to vanish, and aspects of observation, where the hot-spot sources are the predominant contributors to the radiant spectrum of the ship. A normal ship will not produce a radiant spectrum similar to a black body at flame temperatures (i.e., at about 1500° K.).

It might be thought that spectra so grossly different could be distinguished by measuring the slope on the distribution, (i.e., the ratio between any two narrow bands). This is not the case. Both a target ship and a nearby decoy are seen by a seeking missile through a naturally occurring and highly selective filter, namely, the atmospheric path in the line-of-sight. The atmospheric spectral attenuation for path lengths has the effect of making gross-spectral differences appear subtle in bands between atmospheric opacities. Radiation from $CO_2$ in the three to five micron band for example, is largely absorbed by the atmosphere over path lengths longer than two kilometers. Only comparisons over a broad spectral range, such as ratios of band integrals, provide strong distinctions.

A graybody is a temperature radiator whose spectral emissivity is less than unity and the same at all wavelengths. Radiant intensity, J, is the quotient of the radiant power emitted by a source in an infinitesimal cone containing a given direction, by the solid angle of the cone, and is expressed in units of watts per steradian ($W \cdot sr^{-1}$). The numbers in parentheses following the symbol J (e.g., J (3.4–4.3) give the corresponding half band points in units of microns.

An infrared decoy is a countermeasure against heat-seeking, anti-ship missiles. In practice a decoy is deployed between the ship and the anti-ship missile during the search and acquisition phase of the missile's flight for the purpose of attracting the exclusive attention of the missile's homing guidance system. Ideally, the spectral distribution of the decoy is indistinguishable from that of the ship over the band of interest. Assuming that the total spectral band of interest extends only from three to thirteen microns, then the ratio of the radiant intensity emitted in the atmospheric window regions of the three to five micron band to that emitted in the eight to thirteen micron band is the criterion for spectral discrimination. That ratio is denominated at $R_j$ (3–5/-8–13). While is it not possible to assign a single value to this ratio, its value is usually unity or less for a ship. A ratio based upon radiance, $R_n$ (3–5/8–8–13), rather than radiant intensity may be defined in an analogous manner.

Presently a floating pyrotechnic flare burning magnesium-teflon is used to provide a decoy for ships against low flying, heat-seeking missiles. As this type of flare floats directly on the sea surface and projects a flame only on the order of one foot, it is subject to extensive shadowing by waves occurring between it and a low flying missile. Another disadvantage is that the radiant spectrum of magnesium-teflon matches that of a ship only in the three to five micron band; in the eight to fourteen micron band the intensity of the flare is too weak by at least one order of magnitude. Additionally, the recent emergence of tri-metal quantum infrared detectors means that it is now practical to deploy missiles responsive to the eight to fourteen micron band.

SUMMARY OF THE INVENTION

A torch burning a liquid silicone fuel, preferably polydimethylsiloxane, to project a flame with combustion products providing radiance indistinguishable from the signature of a ship in the intermediate infrared spectrum. The torch provides a spectral distribution in both the three to five micron and eight to thirteen micron band that is similar to that of a ship in the near intermediate and far fields of observation.

Accordingly, it is an object of this invention to provide a torch having products of combustion that produce a spectral distribution close to the spectral distribution of a ship.

It is a second object to provide a torch having products of combustion that produce a spectral distribution which in comparison to a ship, is close to unity and therefore less susceptible to spectral discrimination.

It is another object to provide a torch having products of combustion that produce a spectral distribution in the intermediate infrared band with a ratio close to unity between the radiant intensities of the three to five micron band and the eight to thirteen micron band.

It is yet another object to provide a torch having products of combustion that produce a spectral distribution in the intermediate infrared band with a ratio between the radiant intensities of the three to five micron band and the eight to thirteen micron band that simulates the same ratio of a graybody over the temperature ranges of interest.

It is still another object to provide a torch burning a non-toxic fuel.

It is still yet another object to provide a torch generating non-toxic products of combustion.

It is a further object to provide a torch fuel without product of combustion that hinder the operations of a ship's crew.

BRIEF DESCRIPTION OF THE DRAWINGS

A more complete appreciation of this invention, and many of the attendant advantages thereof, will be readily enjoyed as the same becomes better understood by reference to the following detailed description when considered in conjunction with the accompanying drawings in which like numbers indicate the same or similar components.

DETAILED DESCRIPTION OF THE INVENTION

Figure 1:
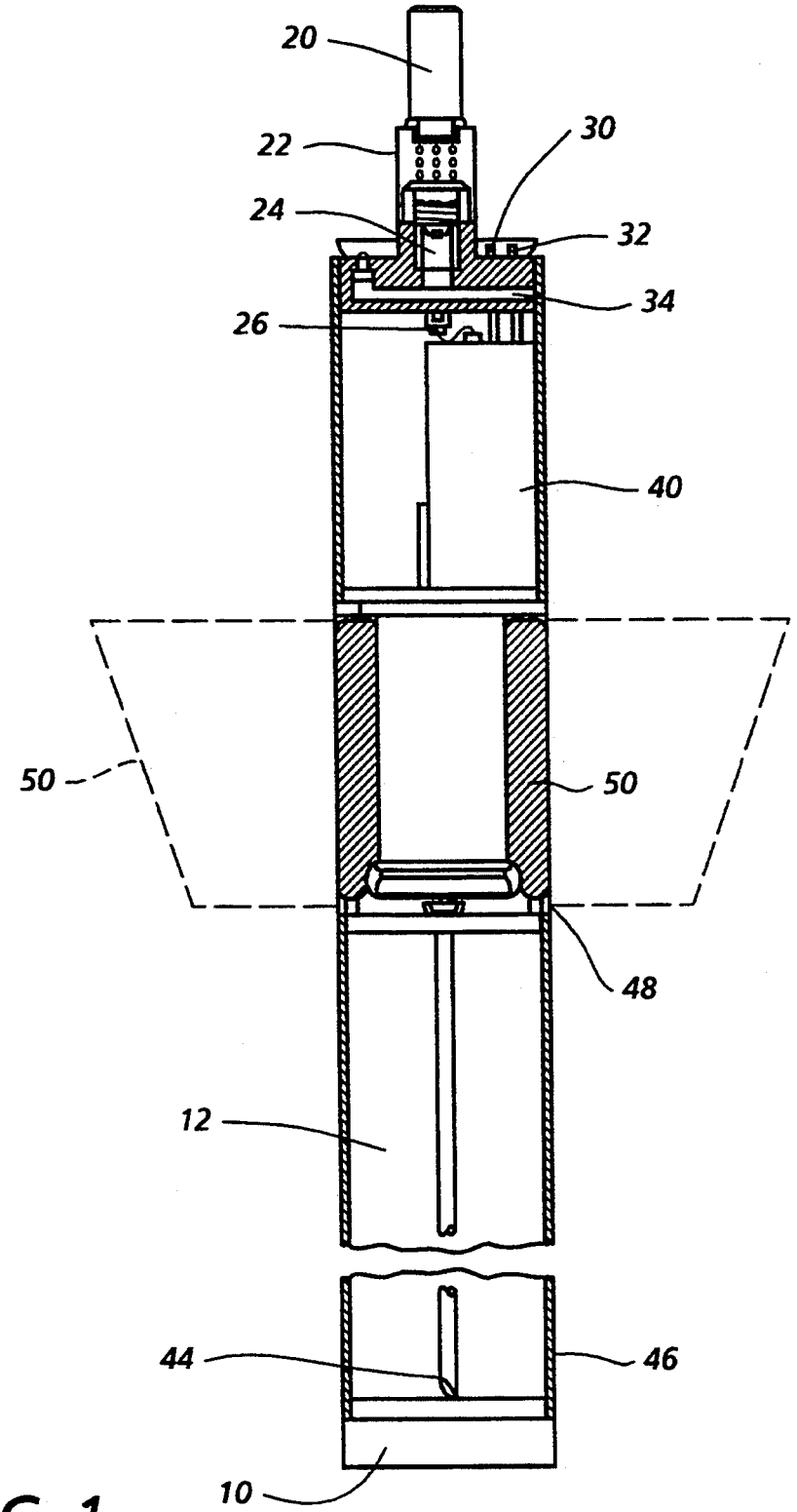
FIG. 1 of the drawings is a front, cross-sectional view of a decoy adapted to burn a liquid hydrocarbon fuel.

A torch decoy is essentially a canister containing a liquid fuel previously a hydrocarbon, a mechanism to expel the fuel, a nozzle to give a spray pattern to the expelled fuel, and a source for igniting the spray in order to create a flame. A cross-sectional view of a torch decoy 10 adapted to burn a liquid siloxane fuel 12 is shown in FIG. 1. The torch decoy 10 is a cylindrical canister fitted at one end with the secondary coil and coil assembly of an induction firing device 20 of the type disclosed in a copending application filed on June 20, 1974, by Frederick E. Warnock, and assigned Ser. No. 481,428, and a propellant case 22, suitable for launching as an ordnance round. A collar to which the propellant case 22 is attached contains a firing pin 24 and an explosive train 26. A fuel nozzle 30 and an ignition nozzle 32 extend through the collar. The ignition nozzle 32 is powered by gas generator 40; both are initiated simultaneously by the firing pin 24 which is released by the impact of decoy 10 with the sea. Release of firing pin 24 is contingent upon a normal sequence of events allowing safety and arming device 34 to arm firing pin 24. The ignitor (not shown) consists of a seven inch flame —the exhaust of a rocket grain fuel used in the gas generator —emitted from nozzle 32. A drag and flotation device 50 surrounding the midsection of the torch is inflated after the torch is launched. When deployed, the flotation device holds the torch upright with nozzles 32 and 34 above the sea. The fuel 12 is in a tank 46 at the base of the canister. An internal gas generator 40 provides about one hundred pounds per square inch of pressure above the fuel 12, forcing the fuel to flow through pickup tube 44 and out of nozzle 30. The nozzle 30 should be designed to produce a narrow conical jet, approximately twenty to thirty feet high, with a fine spray outside the jet extending about one foot above the nozzle. The spray is easily ignited and provides enough heat to in turn ignite the jet of fuel. The cone burns on the outside and volatilizes fuel inside the cone so that the jet broadens as it travels away from the nozzle. The result is a conical flame with an apex at the nozzle and a base at the top of the flame. The height of the conical flame can be as high as thirty feet with a base as large as ten feet in diameter.

In selecting a fuel for a torch decoy, the principal criterion is that the flame of the fuel give as small a value of $R_f(3\text{–}5/8\text{–}13)$ as possible. Polysiloxanes satisfy this criterion.

Polysiloxanes are linear chains having the general chemical composition:

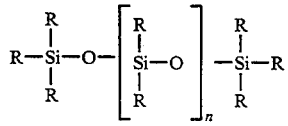

where the substituent, R, may be one or a combination of various groups such as methyl, $CH_2$, phenyl, $C_3H_5$, or a hydrogen atom. The chains vary in length from two siloxane, SiO, groups to several hundred. Since viscosity increases with chain length, an individual compound may be conveniently specified by its viscosity; however, when the chain length is greater than nine (i.e., a viscosity greater than a few centistokes) the compound consists of a mixture of individual compounds of varying chain length and is characterized by an average chain length, n, or by its viscosity. Of all of the compounds of the polysiloxane group, those preferred as a fuel for torch 10 are the polymers of dimethylsiloxane, that is those in which all substituents are methyl. The dimethylsiloxane compound is also one of the most widely used of the silicone fluids and has been readily available at viscosities from 0.5 to 20 centistokes from diverse sources for over twenty years. Additionally, the compound is stable over a wide temperature range, is essentially non-toxic and non-irritating, exhibits little change in physical properties over a wide temperature span, and has a relatively flat viscosity-temperature slope with serviceability from −40° to 204° C. Hydrogen methylsiloxane, n=1, is fairly stable, but generates hydrogen in the presence of certain metals, thereby increasing pressure inside the canister to unacceptable levels while simultaneously dissolving some parts of the canister.

TABLE 1

| CHEMICAL DESIGNATION | J(3.4–4.2) W/SR | J(4.4–5.2) W/SR | J(8–13) W/SR | $R_f(3\text{–}5/8\text{–}13)$ |
|---|---|---|---|---|
| TRICHLOROMETHYLSILANE | 0.51 | 0.7 | 2.4 | 0.5 |
| POLYDIMETHYLSILOXANE | | | | 0.7 |
| TETRAETHYLORTHOTITNATE | 0.96 | 2.9 | 0.97 | 4.0 |

TABLE 1-continued

| CHEMICAL DESIGNATION | J(3.4–4.2) W/SR | J(4.4–5.2) W/SR | J(8–13) W/SR | $R_j$(3–5/8–13) |
|---|---|---|---|---|
| TETRABUTYLORTHOTITNATE | 1.4 | 2.2 | 0.97 | 3.7 |
| TETRAISOPROPYLORTHOTITNATE | 1.9 | 3.2 | 0.38 | 12.9 |
| TETRAETHYLORTHOSILICATE | 1.2 | 4.0 | 2.7 | 1.9 |
| PHENYLTRIMETHYLOXYSILANE | 3.1 | 3.9 | 3.1 | 2.3 |
| HEXAMETHYLSIDILIZANE | 2.1 | 4.9 | 5.2 | 1.3 |
| GAMMA-GLYCIDOXYPROPYL-TRIMETHYLSILANE | 1.5 | 4.1 | 2.2 | 2.5 |
| UNION CARBIDE A1120 SILANE | 0.57 | 1.1 | 0.92 | 1.8 |
| TRIETHYLALUMINUM (TEA) | 4.7 | 6.1 | 2.5 | 4.3 |
| TRIMETHYLALUMINUM (TMA) | 5.6 | 6.3 | 3.7 | 3.2 |
| HEXANE | 4.4 | 8.2 | 1.5 | 8.4 |

Note that $R_j$(3–5/8–13) = (J(3.4–4.2) + J(4.4–5.2))/J(8–13

Figure 2:
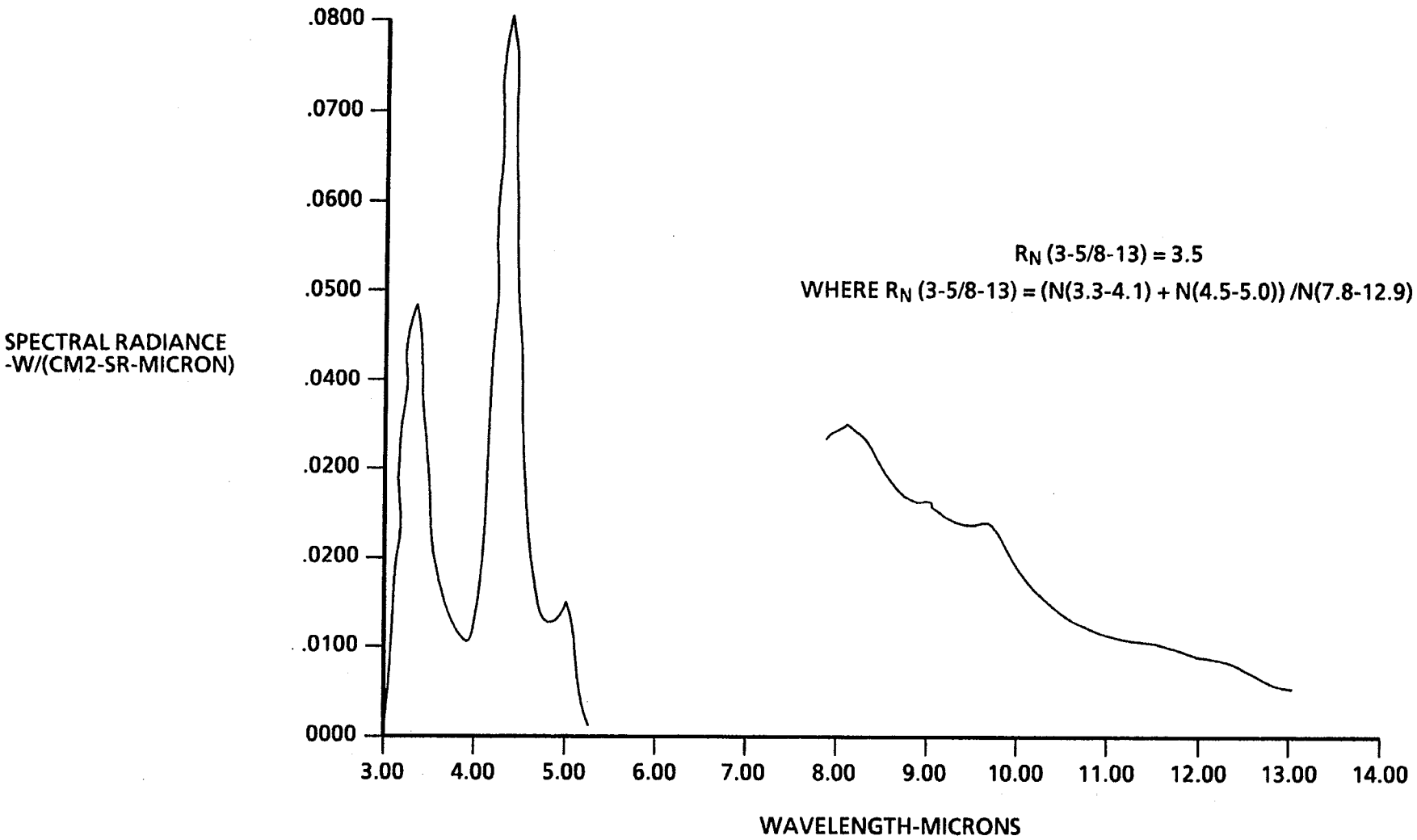
FIG. 2 is a two coordinate graph showing the small diffusion flame spectrum of polydimethylsiloxane with spectral radiance in units of watts per square centimeter-steradian-micron plotted as a function of wavelength over the 3 to 5.3 and 8 to 13 micron bands.

The results of exploratory tests with polydiemthylsiloxane and other fuels, principally organometallic compounds, is summarized in Table 1. Many of the compounds have undesirable or dangerous properties which prevent their use in a torch decoy. Triethylaluminum and trimethylaluminum for example, are pyrophoric. Of those shown, all fuels with a value of $R_j$ (3–5/8–13) less than two are silicon compounds. Only tricloromethylsilane, $CH_3SiCl_3$, and polydimethylsiloxane, with 0.5 and 0.7 respectively, yield values less than one for this ratio. The third silicon compounds, hexamethyldisilizane, $(CH_3)_3SiNHSi(CH_3)_3$, has a value of 1.3. A comparison of the fuels represented in Table 1 indicates that the $R_j$ (3–5/8–13) ratio increases with the carbon to silicon ratio. The values shown in Table 1 were obtained by burning small quantities of the fuels on a 1 inch by 1 inch refractory wick and measuring the radiant intensity and spectral radiance in the 3–5 and 8–13 micron bands. The flames were small, approximately an inch thick and a few inches tall. The spectra observed only approximately resembles the corresponding spectra of the much larger flame generated by the torch decoy. The small diffusion flame spectrum for the polydimethylsiloxane sample is shown in FIG. 2. The value of the radiance observed was 0.26. Although polydimethylsiloxane with a viscosity between 2.0 and 10.0 centistokes at 25° C. is acceptable, the compound most preferred as a fuel 12 for the torch decoy 10 is polydimethylsiloxane with a viscosity of 5.0 centistokes at 25° C. One commercially available compound recommend as a fuel is the Dow Corning 200 polydimethylsiloxane fluid with the following properties:

| | |
|---|---|
| average chain length: | 9 units |
| viscosity at 25° C.: | 5.0 centistokes |
| closed cup flash point: | 135° C. |
| pour point: | −100° C. |
| specific gravity at 25° C.: | 0.920 |
| viscosity temperature coefficient: | 0.55 |
| coefficient of expansion | 0.00105 cc/cc/°C. |

The compound is available from the Dow Corning Corporation of Midland, Mich. General Electric is another supplier. The choice of a compound with a 5.0 centistoke viscosity depends upon three factors. First, a fuel with a flash point not lower than that of JP-5 avoids exposing the ship's crew to the hazard of a more flammable fuel. Second while higher viscosity compounds have high flash points, the viscosity of those compounds at lower temperatures will be too high to provide the desired spray pattern and will be difficult to ignite. Third, polydimethylsiloxane compounds with viscosities lower than five centistokes are costly. On the basis of the first two factors, a 2.0 centistoke compound, which has a flash point of 87° C., compared to 60° C. for JP-5 with a viscosity at −29° C., the low temperature operating limit of the torch decoy, is close to that of JP-5, would be recommended. A 2.0 centistoke compound however, is about twice as expensive as a 5.0 centistoke compound.

JP-5, jet-fuel, may be used for purposes of comparison because it is non-toxic, safe to handle, readily available, and if burned fuel-rich, produces a continum of radiation in all bands of interest. The principal source of continum radiation in a JP-5 flame is free carbon which, if present in sufficient quantity, approaches blackbody radiative characteristics. In a practical size decoy, high flame temperatures are required to match the total radiant energy over the background of a ship with a much larger area than that of the decoy. If the decoy is a blackbody however, then the spectral distribution of the emitted radiation is an indication of its flame temperature and provides an easy basis for discriminating between the decoy and the ship.

Table 2 gives the results of a series of tests comparing the radiant intentisty of JP-5 with polydimethylsiloxane. The fuel in each canister was allowed to stabilize at the temperature indicated and then ignited. The canisters tested were equipped with a fuel nozzle manufactured by Spraying Systems Co., Incorporated, model number 1/8 GG1514. The burn times are limited by the life of the gas generator and not by the amount of fuel. An earlier test using a different fuel nozzle gave average ratios of radiant intensities in the 3 to 5 and 8 to 13 micron bands for JP-5 and polydimethylsiloxane of 3.90 and 0.96, respectively.

TABLE 2

| FUEL (TEMP) | PRESSURE PSI | RADIANT INTENSITY 3.3/4.1 m KW/SR | RADIANT INTENSITY 4.5–5.0 m KW/SR | RADIANT INTENSITY 7.8–12.9 m KW/SR | $R_j$(3–5/8–13) | BURN TIME SECONDS |
|---|---|---|---|---|---|---|
| JP-5(-20F) | 125–140 | 26.4 | 14.3 | 10.0 | 4.0 | 39 |
| JP-5(-20F) | 125–140 | 31.7 | 14.3 | 12.6 | 3.6 | 39 |
| JP-5(80F) | 150–190 | 21.1 | 12.5 | 7.5 | 4.4 | 36 |
| JP-5(80F) | 150–190 | 23.2 | 12.1 | 9.2 | 3.8 | 34 |
| JP-5(140F) | 160–200 | 28.2 | 15.0 | 10.9 | 4.0 | 35 |

TABLE 2-continued

| FUEL (TEMP) | PRESSURE PSI | RADIANT INTENSITY 3.3/4.1 m KW/SR | RADIANT INTENSITY 4.5–5.0 m KW/SR | RADIANT INTENSITY 7.8–12.9 m KW/SR | $R_f$(3–5/8–13) | BURN TIME SECONDS |
|---|---|---|---|---|---|---|
| AVERAGE | — | 26.1 | 13.6 | 10.0 | 4.0 | 37 |
| PDMS(-20F) | 125–140 | 4.2 | 7.1 | 10.9 | 1.0 | 40 |
| PDMS(-20F) | 125–140 | 4.6 | 6.8 | 11.3 | 1.0 | 39 |
| PDMS(80F) | 150–190 | 5.3 | 7.1 | 10.0 | 1.2 | 35 |
| PDMS(80F) | 150–190 | 4.9 | 6.8 | 10.5 | 1.1 | 35 |
| PDMS(140F) | 160–200 | 5.3 | 7.1 | 10.9 | 1.1 | 30 |
| PDMS(140F) | 160–200 | 6.3 | 7.1 | 10.5 | 1.3 | 37 |
| AVERAGE | — | 5.1 | 7.0 | 10.7 | 1.1 | 36 |

NOZZLE USED WAS SPRAYING SYSTEMS MODEL 1/8 GG1514

Figure 3:
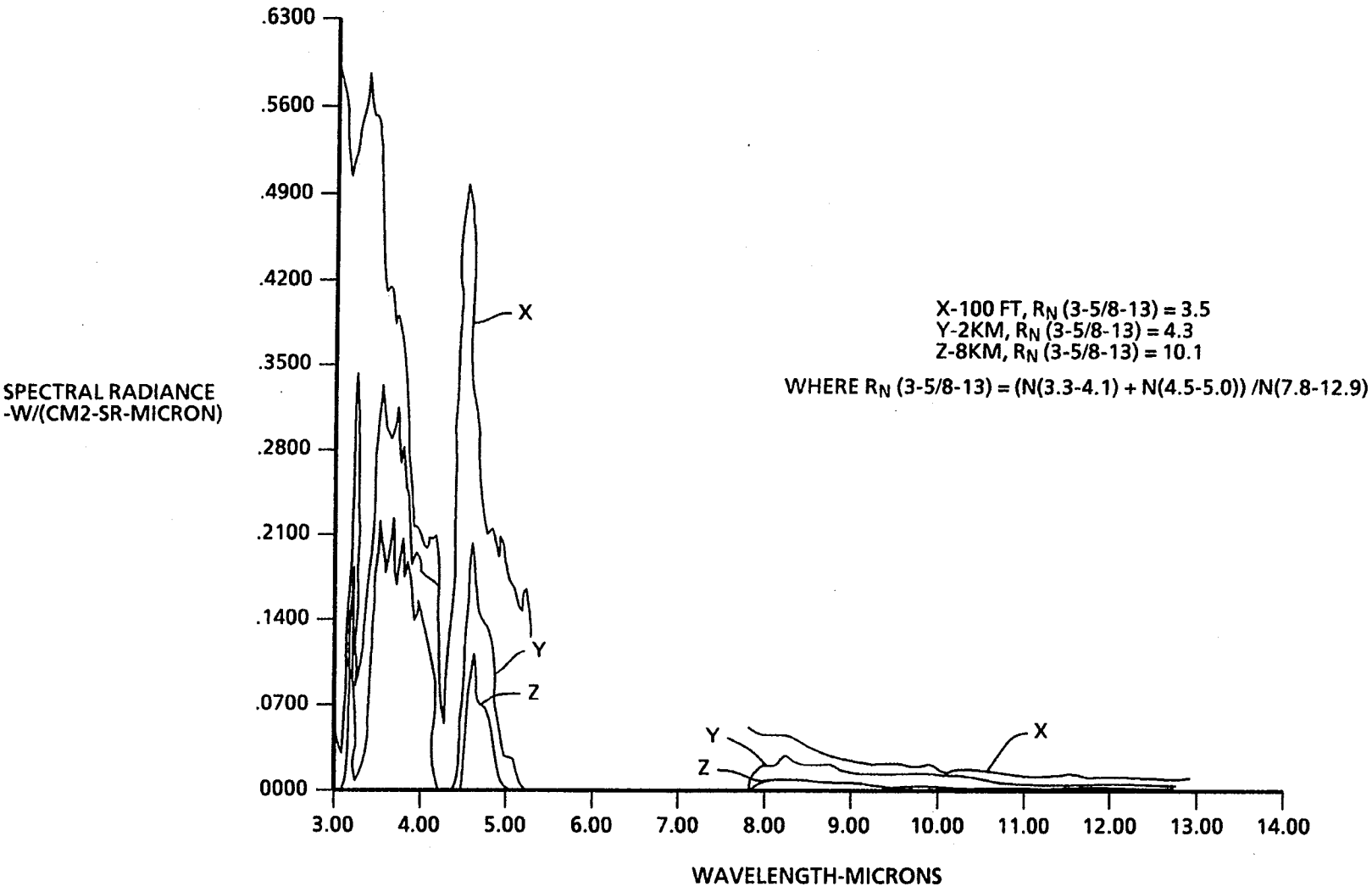
FIG. 3 is two coordinate graph of the large flame spectra of JP-5 taken at one hundred feet (curve X) and corrected for atmospheric transmission at two and eight kilometers (curves Y and Z).
Figure 4:
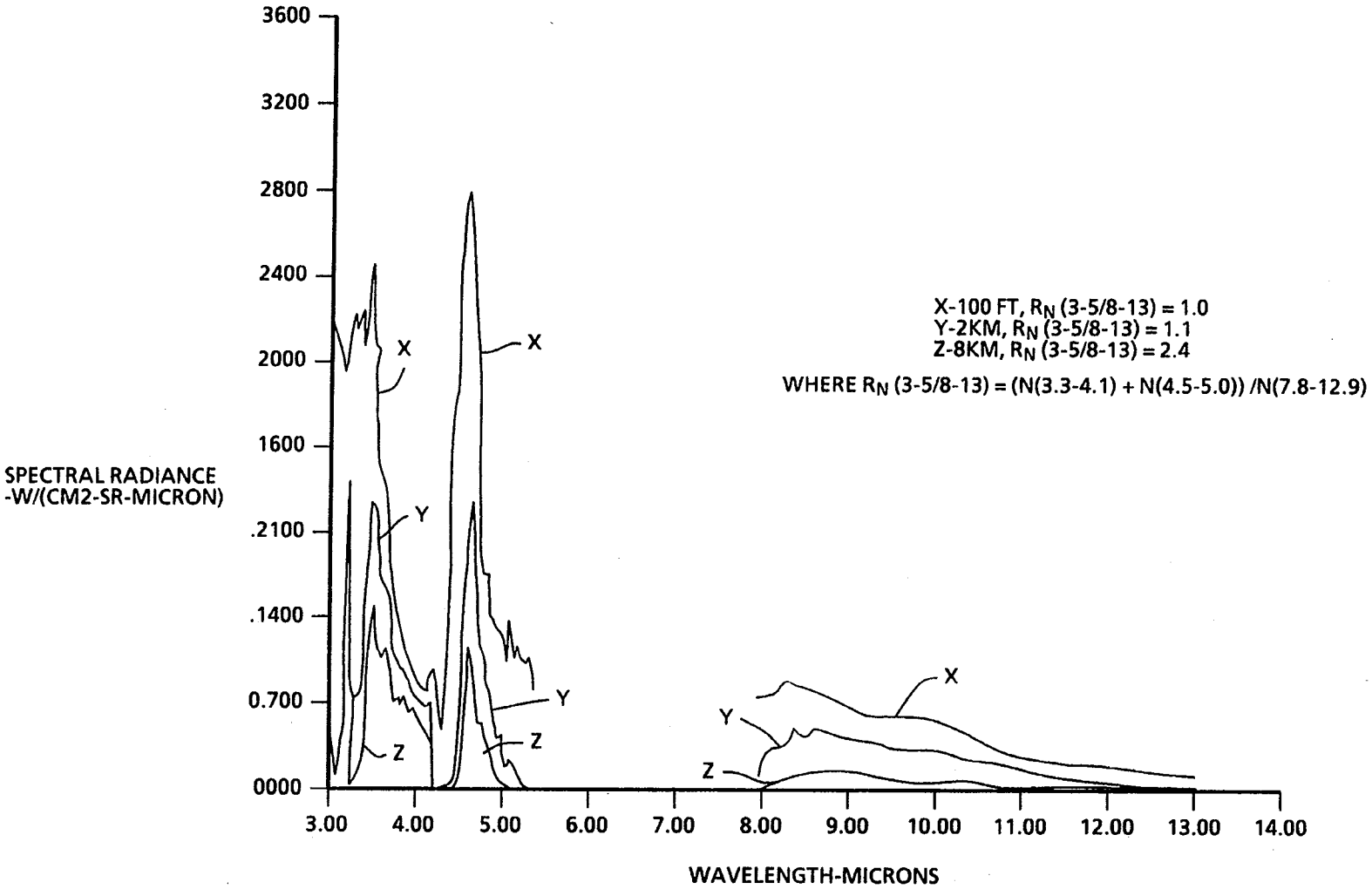
FIG. 4 is a two coordinate graph of the large flame spectra of five centistoke polydimethylsiloxane taken at one hundred feet (curve X) and corrected for atmospheric transmission at two and eight kilometers (curves Y and Z).

FIG. 3 is a graph showing the spectrum of a six inch square area near the centroid of flame from a torch decoy fueled with JP-5 and viewed, for curve X, at a distance of one hundred feet. The corresponding spectra of curves Y and Z were taken as if viewed from distances of two and eight kilometers, respectively, by using values determined with the LOWTRAN 3 atomopheric transmission code for a horizontal sea level path, midlatitude summer typical atmospheric conditions, and a twenty-three kilometer visual range. LOWTRAN 3 refers to the Atmospheric Transmittance From 0.25 to 28.5 Micron Computer Code LOWTRAN 3, written by J. E. Selby and R. A. McClatchey of the Air Force Cambridge Research Laboratories, Hanscomb AFB, Mass. FIG. 4 is a graph showing the corresponding spectra of a flame from a torch decoy fueled with five centistoke viscosity polydimethylsiloxane.

Figure 5A:
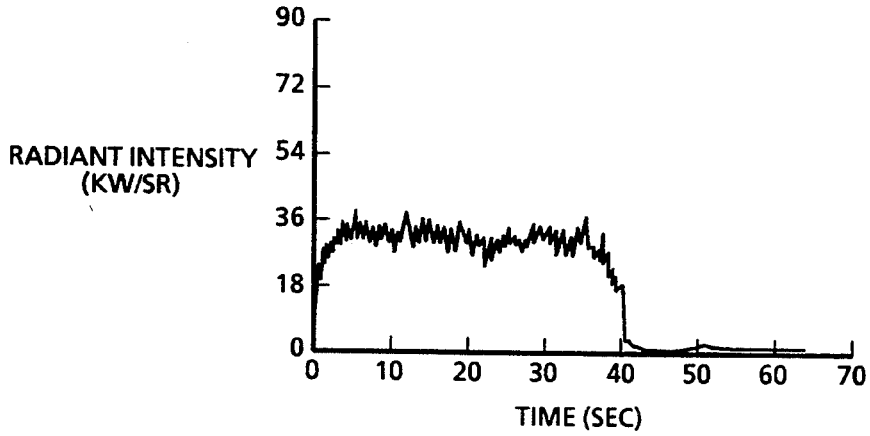
FIGS. 5A, 5B, and 5C are two coordinate graphs showing the radiant intensity in kilowatts per steradian as a function of time, in seconds, for a torch decoy fueled with JP-5.
Figure 5B:
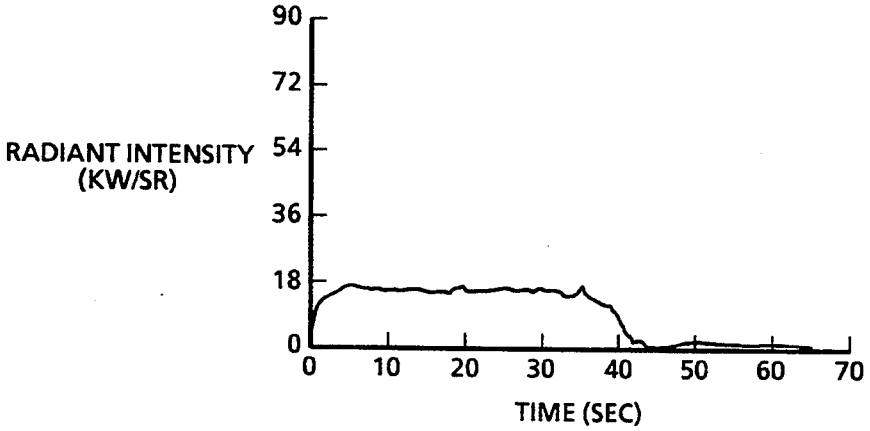
Figure 5C:
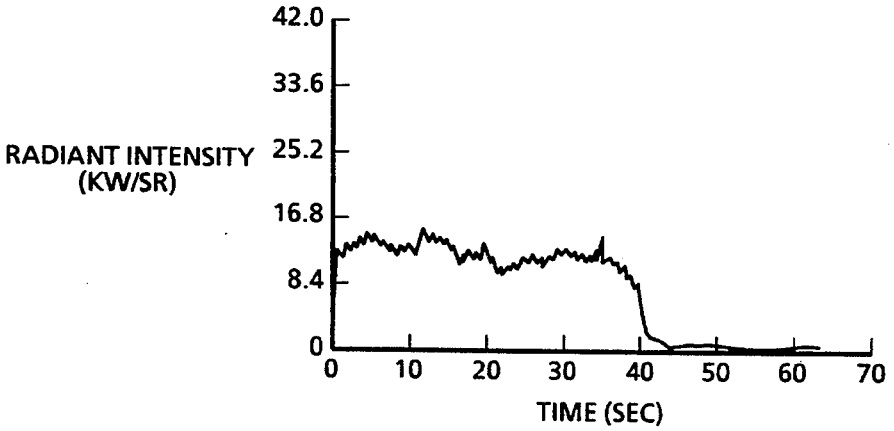
Figure 6A:
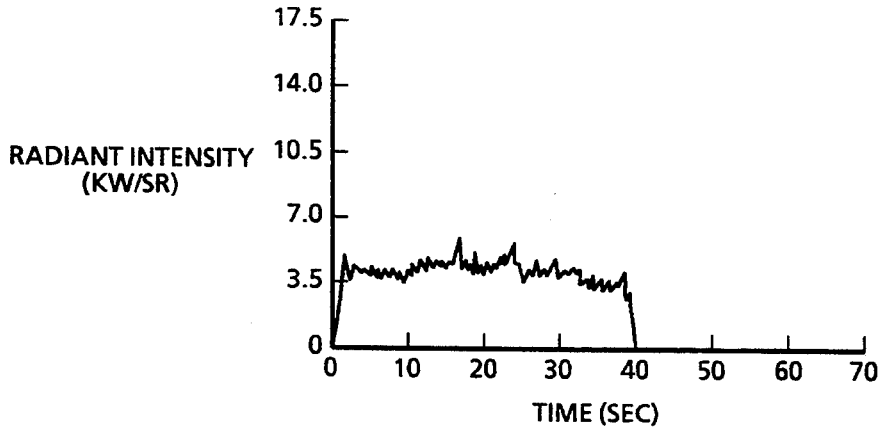
FIGS. 6A, 6B, and 6C are two coordinate graphs showing the radiant intensity in kilowatts per steradian as a function of time, in seconds, for a torch decoy fueled with polydimethylsiloxane.
Figure 6B:
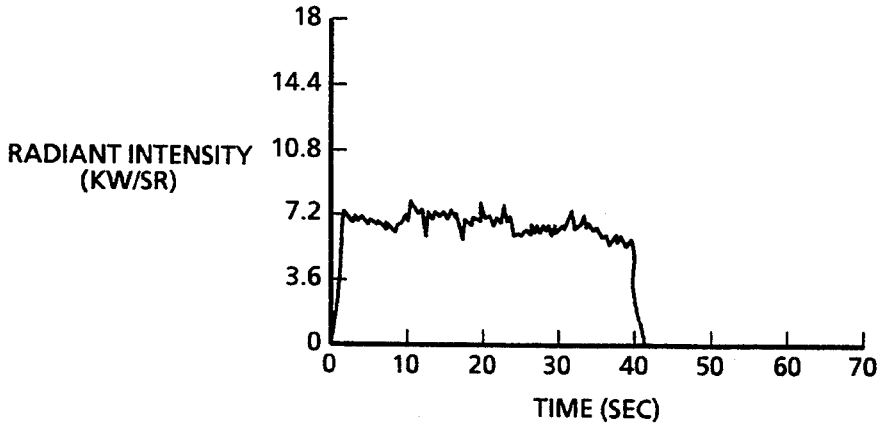
Figure 6C:
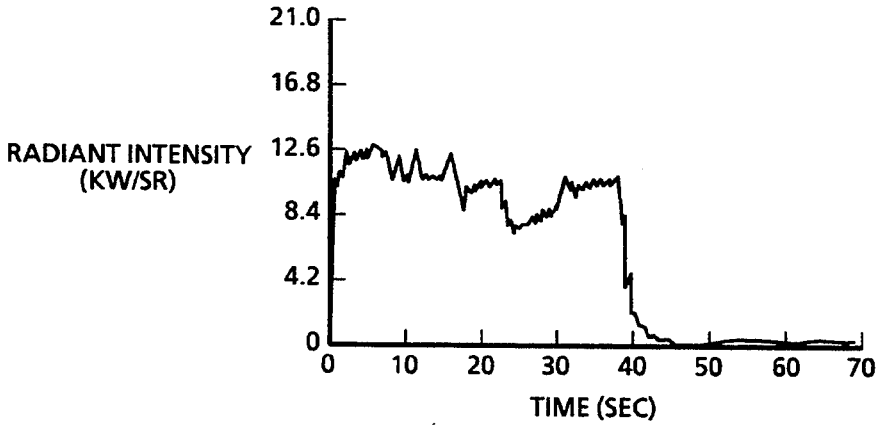

FIGS. 5A, 5B, and 5C are a set of recorder traces giving the history of radiant intensity for a torch decoy fueled with JP-5 over the 3.3 to 4.1 micron, 4.5 to 5.0 micron, and 7.8 to 12.9 micron bands respectively. FIGS. 6A, 6B, and 6C are the corresponding traces for a torch decoy fueled with five centistoke polydimethylsiloxane over the 3.3 to 4.1 micron, 4.5 to 5.0 micron, and 7.8 to 12.9 micron bands, respectively.

Comparison of the combustion and radiation of a polydimethylsiloxane fuel with a hydrocarbon fuel such as JP-5 is indicative of the advantages obtained in practicing the present invention. When JP-5 is burned in air with a fuel-to-air ratio that is fuel-lean, the products of combustion are water vapor and carbon dioxide As the fuel-to-air ratio is made progressively richer, some carbon monoxide is produced at the expense of carbon dioxide; the amount of the former increases while the amount of the latter decreases as the fuel-to-air ratio increases. If the fuel-to-air ratio is increased beyond the point at which carbon dioxide is no longer a combustion product, free carbon is produced. Only a very fuel-rich mixture produces a significant amount of free carbon. The near field spectrum of a flame fueled with a hydrocarbon in a fuel-lean fuel-to-air ratio is little more than a large carbon dioxide spike centered at about 4.3 microns and some emission between 3 and 3.5 microns. At a distance of two kilometers, atmospheric absorption eliminates all of the spectrum except for a small portion of the carbon dioxide radiation. The spectrum of a fuel-rich hydrocarbon burn however, provides considerable continuum radiation, with most of the radiation in the 3 to 5 micron band and a lesser amount in the 8 to 13 micron band. The inferences are first, that flames fueled with hydrocarbons must be very fuel-rich in order to give substantial radiation in the 8 to 13 micron band. Second, that the ratio of radiation in the 3 to 5 micron band to that in the 8 to 13 micron band for hydrocarbons is, excluding the carbon dioxide contribution, fairly high—3.5 to 1 or greater—a ratio that corresponds to a graybody at a temperature of 1100° C. or higher. Decreasing the fuel-to-air ratio lowers the ratio between the bands, but with the detriment of increasing the carbon dioxide contribution at the expense of useful radiation.

Figure 7:
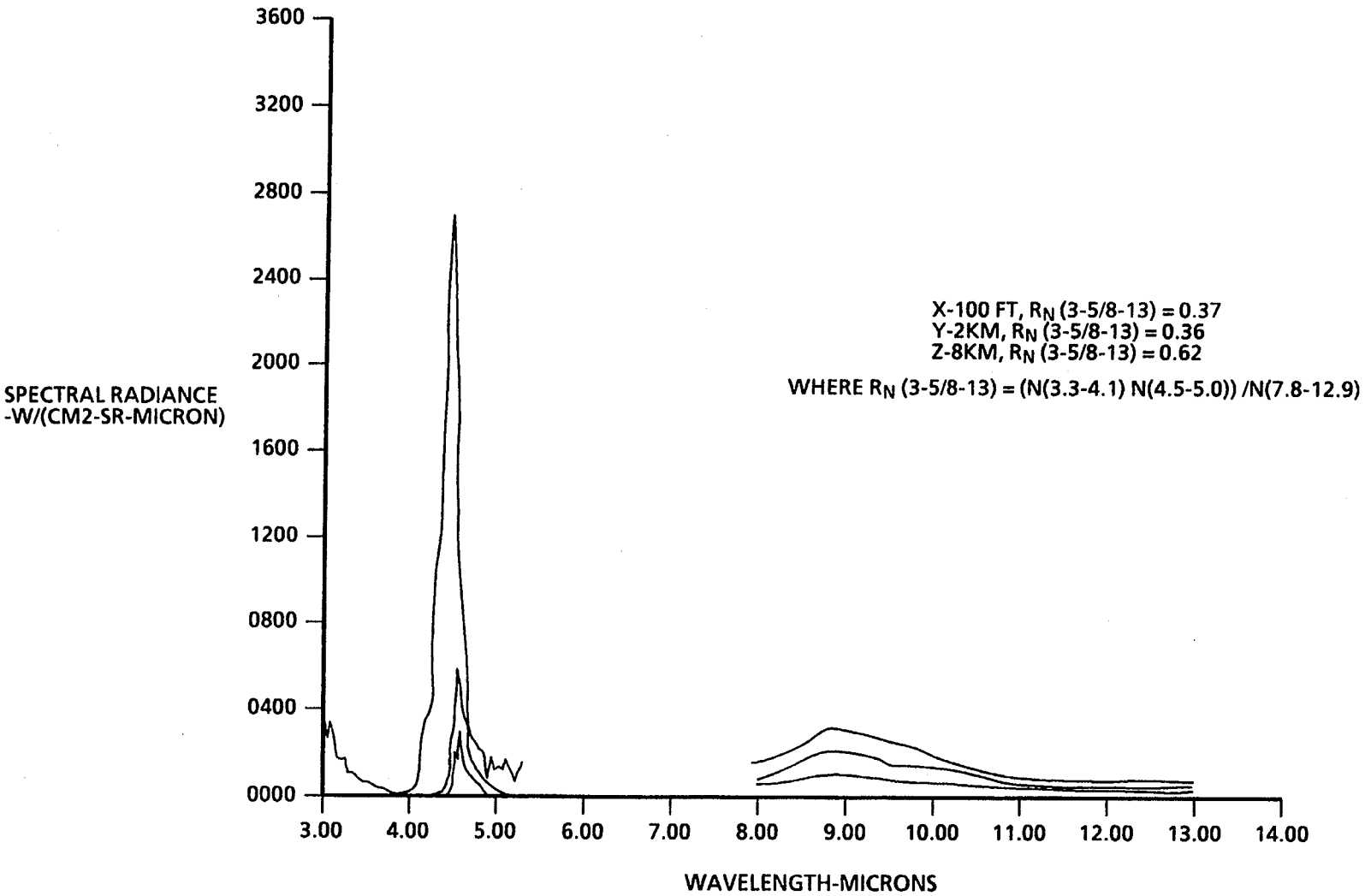
FIG. 7 is a two coordinate graph showing the small diffusion flame spectra of five centistoke polydimethylsiloxane premixed with air, taken at one hundred feet (curve X) and corrected for atmospheric transmission at two and eight kilometers (curves Y and Z).

Polydimethylsiloxane flames behave quite differently. Radiation in the 8 to 13 micron band is primarily produced by high temperature particles of silicon dioxide created during combustion. In order to analyize the combustion of dimethylsiloxane fluids, J. Lipowitz, *Journal of Fire and Flammability*, volume 7, page 482, October, 1976, studied the combustion of octamethyltetrasiloxane, $((CH_3)_2\ SiO_4)_4$, a compound with essentially the same composition as polydimethylsiloxane, and a major pyrolysis product of the latter. FIG. 7 shows the products of combustion of octamethyltetrasiloxane as a function of fuel-to-air ratio. What stands out is the constancy of the silicon dioxide yield with a variable fuel-to-air ratio. The yields of free carbon, carbon monoxide, and carbon dioxide however, vary with the fuel-to-air ratio in similitude to the variations of those products in a flame fueled by a hydrocarbon. The amount of free carbon relative to silicon dioxide may be reduced by lowering the fuel-to-air ratio of polydimethylsiloxane; at a ratio of 2.7 times stoichiometry or less the yield of free carbon is negligible. Further decreases in the fuel-to-air ratio increases the amount of the carbon dioxide at the expense of carbon monoxide yield to be made negligible. This implies that a considerable degree of signature improvement can be obtained with polydimethylsiloxane by lowering the fuel-to-air ratio. The curves of FIG. 7 give the small diffusion spectra of a flame fueled by polydimethylsiloxane premixed with air in a fuel-lean air-to-fuel ratio. Curve X is the near field spectrum, determined at one hundred feet, while curves Y and Z are the intermediate and a field spectra determined by correcting curve X for atmospheric transmission at two and eight kilometers, respectively, using the LOWTRAN 3 computer code for midaltitude summer typical atmospheric conditions allowing a twenty-three kilometer visual range over a sea level horizontal path. Note that the spectra of both FIGS. 4 and 7 show a significant amount of radiation in the 8 to 13 micron band. The striking difference between the spectra of FIGS. 4 and 7 is the near absence of radiation emitted in the 3 to 4 micron window by the fuel-lean flame of FIG. 7. This results in a decrease in $R_n$(3–5/8–13) by a factor of three at the one hundred foot range and by a factor of four at the eight kilometer range. Most of this radiation is absorbed by the carbon dioxide in the atmospheric transmission path. Incomplete adsorption is due to the greater broadness of the high temperature emission spectrum in comparison to the lower temperature absorption spectrum.

Figure 8:
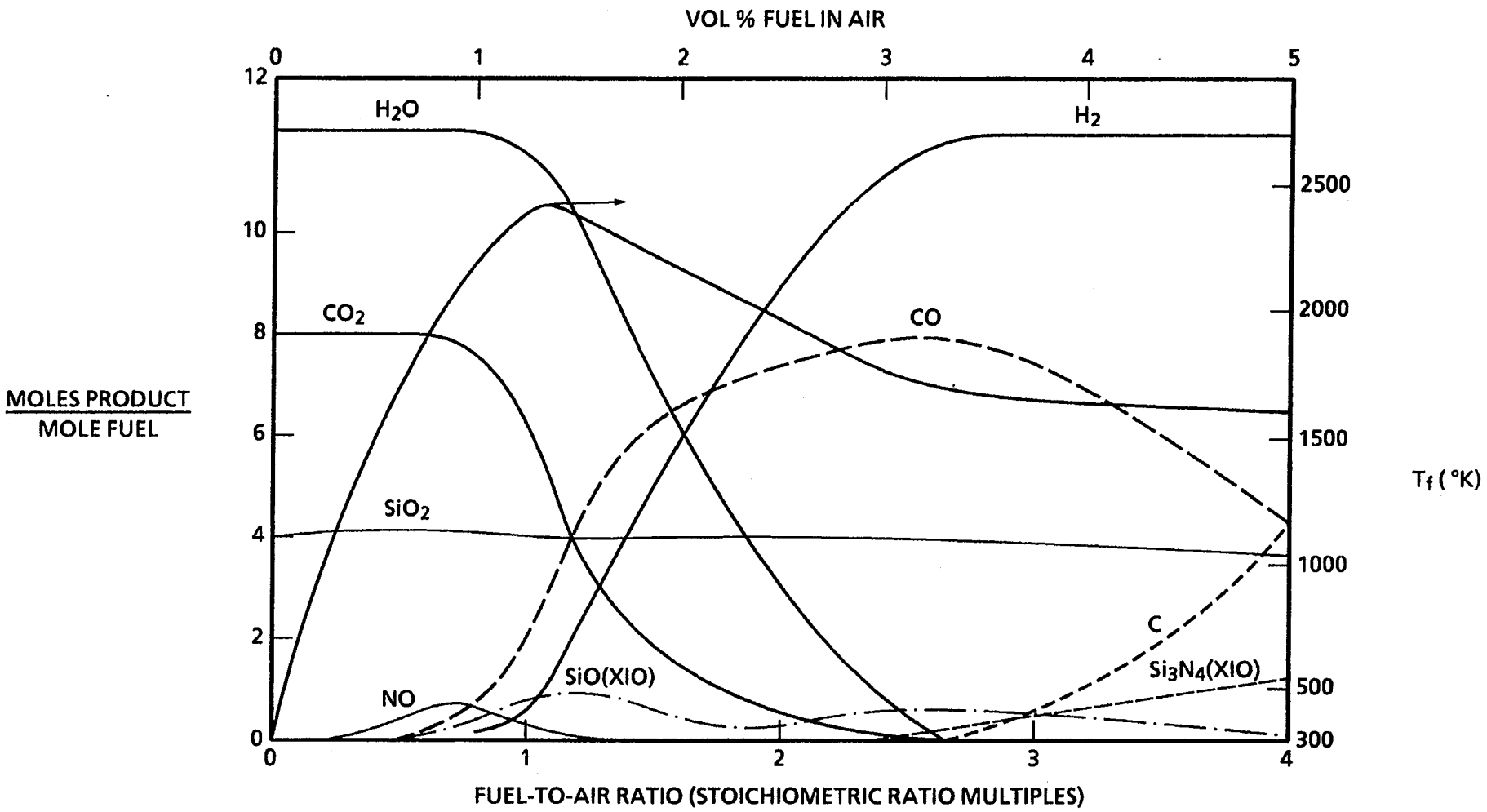
FIG. 8 is a two coordinate graph prepared by J. Lipowitz of Dow Corning Corporation showing the quantity of products of combustion in terms of moles per mole of fuel as a function of the fuel-to-air ratio, for a cyclic dimethylsiloxane fuel.

Referring now to FIG. 8, a graph prepared by J. Lipowitz, it may be seen that with a fuel-to-air stoichiometric ratio of 2.7 or less, carbon is eliminated as a product of the combustion of a cyclic dimethylsiloxane $((CH_3)_2SiO)_4$; the principal remaining products being hydrogen and carbon monoxide. The emission spectrum of hydrogen has no strong bands in either the 3 to 5 or 8 to 13 micron regions. Carbon monoxide has a strong emission band at 4.6 microns, part of which spills over into the carbon dioxide absorption band and is quickly attenuated by the atmosphere. The part of the carbon monoxide emission that remains is substantial and observable even over an eight kilometer atmospheric path, a reason for using a leaner fuel-to-air ratio in order to increase the production of the atmospherically absorbable carbon dioxide at the expense of the atmospherically transmissible carbon monoxide. While a flame that is fuel-rich by a factor between 2.7 and 3.5 is typical, a fuel-to-air ratio of 2.7 times stoichiometric of less is required to eliminate free carbon as a combustion product of dimethylsiloxane fuel.

Two conclusions are drawn from the tests comparing flames fueled with JP-5 to those fueled with polydimethylsiloxane. First, flames fueled with polydimethylsiloxane produced under the same conditions as flames fueled with JP-5 have values of $R_j$ (3–5/8–13) that are four to six times lower than the corresponding values for the flames fueled with JP-5. Second, the radiant intensity in the eight to thirteen micron band for flames fueled with polydimethylsiloxane is either equal to or greater than, generally the latter, the radiant intensity of flames fueled with JP-5.

The values of the curve given in the graph for FIG. 2 were obtained by eliminating the contribution of the $CO_2$ combustion products in the three to five micron band with the rationale that in practice the $CO_2$ contribution would be largely absorbed by the atmosphere. The measurements of $R_j$ (3–5/8–13) and $R_n$ (3–5/8–13) were often made in the near field however, so that the $CO_2$ radiation was not completely absorbed. Therefore, in order to more closely represent intermediate and far field values, the measurements excluded the $CO_2$ contribution.

What is claimed, and desired to be secured by a Letters Patent of the United States, is:

1. A method of decoying heat seeking, antiship missiles comprising:

(1) spraying a fuel consisting essentially of a liquid polydimethylsiloxane having a viscosity of from about 2.0 to 10.0 centistokes at 25° C. to form an inverted cone having its vertex at approximately sea level and its base at about 20 to about 30 feet above sea level;

(2) igniting the fuel; and (3) continuing to feed the fuel to the resulting cone of flames.

2. The method of claim 1 wherein the viscosity of the polydimethylsiloxane is approximately 5 centistokes at 25° C.

3. The method of claim 1 wherein the base of the cone is not more than ten feet in diameter.

* * * * *